US007621312B1

(12) United States Patent
Figura et al.

(10) Patent No.: US 7,621,312 B1
(45) Date of Patent: Nov. 24, 2009

(54) REMOVAL DEVICE AND METHOD FOR VERTICAL BLINDS

(76) Inventors: John Joseph Figura, 9816 Simonton Ct., Murrells Inlet, SC (US) 29576-8370; Barbara Minnetta Figura, 9816 Simonton Ct., Murrells Inlet, SC (US) 29576-8370

( * ) Notice: Subject to any disclaimer, the term of this patent is extended or adjusted under 35 U.S.C. 154(b) by 35 days.

(21) Appl. No.: 12/164,050

(22) Filed: Jun. 28, 2008

(51) Int. Cl.
*E05D 15/00* (2006.01)
*E06B 3/12* (2006.01)

(52) U.S. Cl. ..... 160/208; 160/236

(58) Field of Classification Search ..... 81/3.55, 81/124.2, 485; 362/578, 120, 119, 102; 160/405, 160/178, 1 V, 402, 383, 208, 167 V; 7/165, 7/166; 30/305, 299; 294/49, 19; 29/239, 29/229, 225

See application file for complete search history.

(56) References Cited

U.S. PATENT DOCUMENTS 3,190,250 A 6/1965 Hinden
4,277,872 A 7/1981 Lewis
4,942,655 A 7/1990 Buzzelli
5,044,192 A 9/1991 Sanmiya

*Primary Examiner*—Katherine W Mitchell
*Assistant Examiner*—Jeremy C Ramsey
(74) *Attorney, Agent, or Firm*—Dorothy S. Morse

(57) ABSTRACT

A removal device and method of use that allows easy detachment of a suspended vertical blind slat's upper end from the generally C-shaped clip or other openable fastener suspending the slat for movement along a track. The device has a tubular and/or cylindrical configuration with preferred length and diameter dimensions of approximately four and two inches, respectively. Clip-releasing projections are connected across one end of the main body, in positions closely spaced apart from one another, but not in contact with one another. A light source can be optionally attached to the removal device in several configurations, to provide enhanced illumination of the fastener holding the vertical blind slat in place and thereby facilitate alignment of the lateral edges of the projections with the fastener before the needed upwardly-directed dislodging force is applied. Use of the removal device does not injure the projections, the slat, the operator, or the fastener.

13 Claims, 3 Drawing Sheets

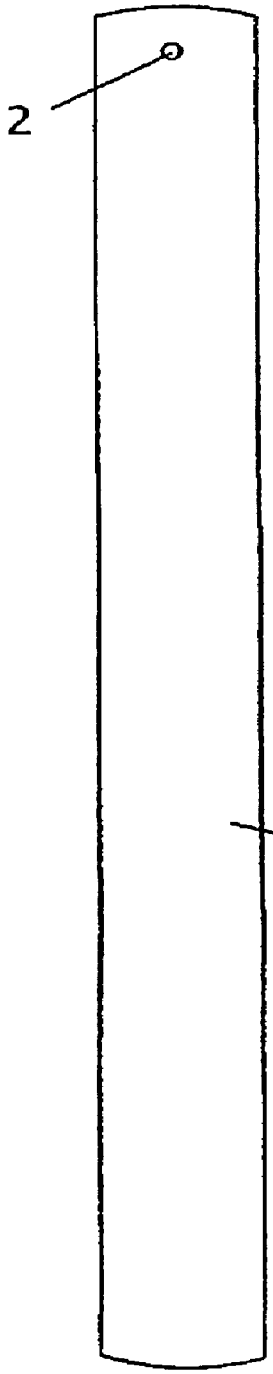
FIG. 1
PRIOR ART
FIG. 2
PRIOR ART
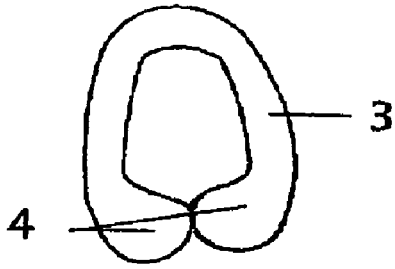
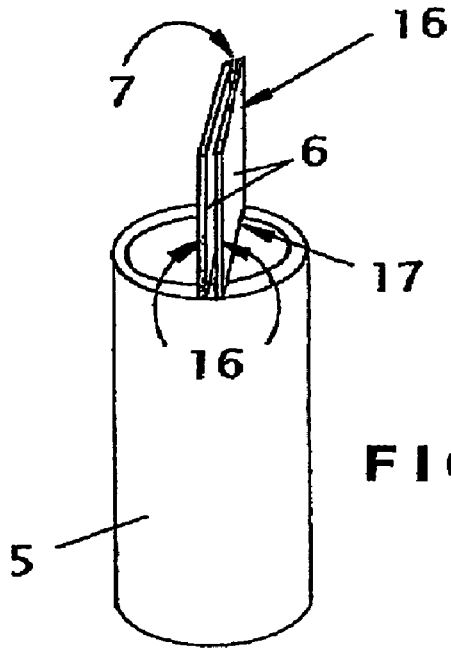
FIG. 3

REMOVAL DEVICE AND METHOD FOR VERTICAL BLINDS

CROSS-REFERENCES TO RELATED APPLICATIONS

None

BACKGROUND OF THE INVENTION

1. Field of the Invention

The present invention relates to vertical blinds, the C-shaped fasteners commonly used to suspend vertical blind slats from an overhead track, and hand-held tools used to open the tightly-biased ends of a C-shaped fastener to release a suspended vertical blind slat from its usable position, specifically to a removal device and method of use that allows for prompt and easy detachment of a vertical blind slat from the generally C-shaped fastener connected to the upper end of the slat while it is in its suspended position of use. The present invention device has a rigid main body that in its most preferred embodiment is tubular in construction, and further has two rigid projections extending from one end of the main body. The projections are only connected to the main body, and not to one another. The projections are also closely spaced-apart, and for most effective use, it is preferred that the open-sided and open-ended gap between them is only slightly larger than the thickness dimension of the targeted vertical blind slat in need of separation from its supporting fastener, which may be a thickness slightly larger than one-thirty-seconds of an inch, but not limited thereto. When a present invention removal device is used, an operator holds it in one hand and places each projection on a different side of a vertical blind slat immediately below the central hole in the upper end of the slat used for fastener connection. This places the present invention device in a horizontally-extending orientation, wherein the one of the lateral edges of each projection is in a position above its opposing lateral edge (in contrast to a horizontally-extending orientation with one of the projections in a position above the other). The operator then moves the main body slowly in an upwardly direction, which causes the uppermost sides of the two projections to exert a constant and steady upwardly-directed force against the closed ends of the C-shaped fastener (or other substitute fastener with opposed lower ends that are biased into a closed position), which causes the ends of the C-shaped fastener (or substitute fastener) to open sufficiently so that the slat drops away from the fastener via the force of gravity. When slats are positioned in front of a sliding glass door, they typically are only an inch or so above the floor, so that the slat does not have far to move when it drops. The operator can then use one or both hands to transport the slat to a remote location. The present invention is used without injury or damage to the projections, the vertical blind slat, the fastener, adjacent surroundings, or the operator. Since the operator typically stands on a ladder, step-stool, or chair, and reaches upwardly to align the lateral edges of the present invention projections under a fastener on both sides of the slat, for the operator's benefit the main body of the present invention is generally configured to be small, lightweight, and easily hand-held. However, the main body of the present invention is not limited in size or configuration, although it is preferred for the main body to have a cylindrical shape with a length dimension of approximately four inches and a diameter dimension of approximately two inches. Tubular construction is also preferred, although not limited thereto. In addition, both the main body and its attached projections must have sturdy construction to be able to exert the strong force needed to open a fastener's tightly-biased ends. Furthermore, since the operator typically uses the present invention in an overhead position and behind a valence, the present invention may optionally have an associated means for enhanced illumination of the fastener's releasable ends. One means of enhanced illumination includes the attachment of a light source to the tubular main body of the removal device via a threaded connection, wherein the released light travels through the tubular main body, around the projections, and also through the gap between the projections, to illuminate the ends of the C-shaped fastener (or substitute fastener) prior to and during slat removal. Other illumination enhancement may involve lateral attachment of a light source to the main body via straps, hook-and-loop fasteners, double-sided adhesive strips, and the like. Release of vertical blind slats is contemplated for a variety of circumstances, including but not limited to, when one or more slats are broken and in need of replacement, when one or more slats are discolored and/or unsightly due to wear or extended exposure to strong sunlight and in need of replacement, when one or more slats are prematurely deteriorated as a result of interaction with children or pets (cats, dogs, or other), to replace previously-installed vertical blinds with better quality slats, and/or when exchange of slats is needed for decorative update of a room or living space. It is important to understand that the present invention is only employed for removal of a vertical blind slat from its associated fastener, not for attaching the fastener to the slat (which would require other design considerations).

2. Description of the Related Art

Vertical blinds are often hung in front of a sliding glass door, or a large picture window, using one C-shaped clip with its ends tightly biased together to engage the central hole in the top end of each slat, with the fasteners and holes hidden behind a horizontally-extending valence for decorative enhancement. Once suspended in their usable position, adjacent slats can be positioned to completely cover the associated window or door, or moved via connection to an overhead track for collective positioning on one side, or both sides, of the associated window or door to uncover it. In addition, each slat can also be rotated 180-degrees from left-to-right, and vice versa, to control the amount of light reaching the interior space behind it. Setting vertical blind slats into the clip on an overhead track is usually a simple task. One only needs a reasonably steady hand to slide the slat hole into the receiving clip's center portion. However, while vertical blind slats are relatively easy to install, the clips used are not easily released when a slat needs replacement. At the present time, removing a slat from a vertical blind track is a daunting task. The usual approach is to get on a ladder or chair and, once within reach, try to manipulate the ends of the clip through pressure on the slat at the point where the clip is located, using a screwdriver or other pointed and/or elongated hand tool. Very often in the frustration of failing to loosen the slat from the clip, one places too much pressure on the slat hole or clip, and something breaks. Taught wiring has also been tried. However, although it passes well enough between the ends of the clip, it became stuck and was difficult to remove from the clip. Adding to this frustration, it is a nearly impossible task to find/purchase replacement slats and clips. The answer is not to make the ends of the vertical blind clips easier to release, but to find an easier way to open them. The ends of the clip need to remain firmly biased together to successfully keep an associated slat attached to an overhead track, as well as properly aligned with adjacent slats for effective use, particularly while the slat is collectively moved or rotated with the other slats in the vertical blind assembly, as when slats are moved too quickly (and this frequently occurs) they can become temporarily tangled with one another, resulting in the exertion of additional pressure on each of the tangled slats' upper ends. Furthermore, while the positioning of vertical blind fasteners behind a valence enhances the decorative look of the vertical blinds, the valence reduces the available light in and around the fasteners should a slat need replacement. The difficulty of replacing a slat is also enhanced by the elevated positioning of the fasteners that typically requires a person to use a ladder, step-stool, or chair to reach them, and the need for working with arms in an outstretched and/or elevated position. Although people have used screwdrivers and other elongated tools to pry open the ends of the fasteners associated with vertical blind slats, due to the elevated working position, the small working space behind valences, and the reduced light conditions typically available around vertical blind fasteners, the risk of tool slippage is high, which may lead to damage/injury of the slat, the fastener, the tool, adjacent surroundings, and/or the operator. An easier way to release a vertical blind slat from its installed position is needed, to be able to exchange it for a replacement slat rapidly and without injury or damage to the operator, the fastener, surroundings, or the slat, whether substituting a new slat for a physically damaged one or for general decorative update. During use of the present invention, an operator will experience time and cost saving benefits while achieving slat replacement, the additional benefit of reduced hassle and frustration, as well as the benefit of a substantially reduced risk of injury.

Devices are known that assist in the attachment of retaining clips. One such example is disclosed in U.S. Pat. No. 4,942,655 to Buzzelli (1990). The Buzzelli invention is designed and constructed to hold an "E" clip, and then install it in its desired position of use, such as in the carburetor of an internal combustion engine. The working end of the Buzzelli invention has a recess with substantially parallel sides and a closed bottom surface into which the "E" clip is placed prior to its installation use. The opposing end of the Buzzelli invention is a polygonal shape that permits support during its use by a tool bit holder. Thus, the Buzzelli invention is different from the present invention in several significant ways. First, it is supported by another tool during its use, and it is used to install an "E" clip, not open the ends of the "E" clip to release another object. Furthermore, the length of the recess in the Buzzelli invention is small, just sufficient to hold the non-opening end of an "E" clip. In contrast, the most preferred embodiments of the present invention have a cylindrically-shaped main body with two plate-like clip-releasing projections mounted across one end of the main body. There is no connection between the clip-releasing projections, even though they are closely spaced apart, and the gap between them is open-sided and open-ended. In the most preferred embodiment of the present invention the gap is slightly larger than the thickness dimension of the vertical blind slat targeted for release from its associated fastener. Thus, the opening between the clip-releasing projections in the present invention is necessarily narrower than the space between the Buzzelli blades, in many applications only slightly larger than one-thirty-seconds of an inch, while the Buzzelli gap has a substantially greater thickness dimension (larger than the thickness dimension of the clip/fastener its holds). Furthermore, if the present invention open-sided and open-ended gap was constructed with sufficient thickness dimension to hold a fastener/clip, the surrounding projections creating the gap would be too far apart to effectively apply an upwardly-directed force against both of the tightly-biased fastener ends at once to pry them open and allow a vertical blind slat to drop, the purpose for which it was created. Also, the lateral edges of each clip-releasing projection of the present invention must at a minimum extend the full dimension of a tubular main body for support, and the distance beyond the end of the main body that the clip-releasing projections of the present invention extend must at a minimum be the distance across one-half of the vertical blind slat targeted for release (commonly two-inches). However, in the most preferred embodiment of the present invention it is contemplated for the length dimension of the projections to extend slightly more than one-half of the slat's width dimension to ensure secure engagement between the uppermost lateral edges of the projections and the movable ends of the clip. Furthermore, the operative portion of the Buzzelli invention is its distal end, which receives the "E" clip for installation. In contrast, when one side of a vertical blind slat is positioned within the open-sided and open-ended slot of the present invention and the projections are located immediately below a C-shaped clip, the present invention is placed into a horizontally-extending orientation with one lateral edge of each projection positioned above the opposing lateral edge on the same projection. Thus, it is the uppermost lateral edge of each present invention projection that applies the constant and steady upwardly-directed force to the ends of the C-shaped clip (or substitute fastener) to pry them open and becomes the operative portion of the invention, and not the adjacent distal end (as in the Buzzelli invention). A further two-pronged invention for installation of "E" clips is disclosed in U.S. Pat. No. 4,277,872 to Lewis (1981). In fact, the Buzzelli invention was an improvement over the Lewis invention since the "E" clip demagnetized during use of the Lewis invention, and the Buzzelli invention overcame that problem. However, although the Lewis invention is also configured to remove clips, as well as install them, there are important differences between the Lewis invention and the present invention that distinguish one from the other. First, the length of the slot formed by the Lewis blades in FIG. 1 does not appear to be sufficient to reach at least half way across the width of a vertical blind slat to force open the tightly-biased closed ends of a C-shaped clip and release the slat. Also, as pointed out in column 2, lines 14-16, of the Lewis disclosure, removal of the "E" clip in FIG. 2 is accomplished by a tooth 14 on the end of its blades 13, and not the blades themselves. In column 2, lines 19-21, of the Lewis disclosure a tooth for removal purposes is also mentioned, stating that tooth 14*a* in FIG. 5 can have a point 18 for use in removing clips 15 and 16 respectively in FIGS. 2 and 3. Thus, it is intended for a tooth and not the lateral edges of the Lewis prongs to release a retaining clip.

Other devices are known with two closely spaced-apart projections that create a slot used for fastener removal purposes, but they do not have the same structure and positioning as the projections of the present invention and cannot accomplish the same vertical blind slat removal task with the same speed, efficiency, and injury-reducing benefit that is provided by the present invention. In addition, many such devices use their slot's interior surfaces as the operative portion to provide twisting forces, instead of using a lateral edge adjacent to the slot (as in the present invention) to apply a constant and steady upwardly-directed fastener-releasing force. The sheet metal tool disclosed in U.S. Pat. No. 3,190,250 to Hinden (1965) is used to assemble one sheet metal component to another. It locks a sheet metal air-turning blade to a blade rail using twisting forces applied via the interior surfaces of a slotted configuration in its distal end. Although the Hinden invention has two closely-spaced apart projections that form its slotted configuration, they are connected together at the bottom and do not form an open-sided and open-ended slot or gap, which is different from the projections in the present invention which are not connected to one another, instead only having connection to one end of the open-ended tubular main body. Furthermore, the interior surfaces of distal tip's slotted configuration provide the operative portion of the Hinden assembly tool, and not lateral edges, as in the present invention removal device. Another two-pronged invention is the lug straightener disclosed in U.S. Pat. No. 5,044,192 to Sanmiya (1991). The two prongs of the Sanmiya invention have a piece of a lower portion 18 extending between them and connecting one to the other. Thus, similar to the Hinden invention, an open-sided and open-ended slot or gap is not created that would allow light to pass through it, as in the present invention for better clip visibility during use. In addition, similar to the Hinden invention, it is the interior surfaces of distal tip's slotted configuration that provide the operative portion of the Sanmiya invention, and not lateral edges, as in the present invention. Thus, a tubular device with projections or plates closely spaced apart from one another, but not in contact with one another to form an open-sided and open-ended gap, and further with lateral edges that are used to apply a substantially linear and upwardly-directed force instead of rotational or twisting forces, is not currently known, nor is any device known that is similar in structure to the present invention for use in conveniently, rapidly, and safely removing an installed vertical blind slat from its supporting clip while the slat remains in its suspended position of use, without damage to the slat, the clip, the device, surrounding areas, or the operator. Those who could benefit from such a device include home décor businesses, window treatment businesses (such as for in-home demonstrations), furniture stores (for changing décor and color themes to keep up with fashion trends), new construction, interior decorators, home improvement stores, churches, hospitals, nursing homes, schools, hotels, and motels, to name a few.

BRIEF SUMMARY OF THE INVENTION

The primary objective of this invention is to provide a removal device that quickly and easily releases a vertical blind slat from the fastener suspending it in place, without causing damage to the slat, the fastener, the device, or surrounding areas. It is also an objective of this invention to provide a removal device for vertical blind slats that reduces the time an operator must spend on an elevated support surface for slat replacement and also substantially reduces the risk of injury to an operator using it for slat removal as compared to slat removal using an elongated tool, such as a screwdriver. Another objective of this invention is to provide a removal device that is small, hand-held, and easily manipulated by an adult human hand. Yet another objective of this invention is to optionally provide a removal device that can illuminate the top end of a vertical blind slat for fast and easy engagement of the operative portion of the removal device with the fastener holding the slat in place. It is also an objective of this invention to provide a removal device having sturdy construction and simple low cost manufacture.

The present invention, when properly made and used, provides a removal device and method of use that allows easy detachment of the upper end of a suspended vertical blind slat from the generally C-shaped fastener (or substitute fastener) holding the slat in place for movement along a track. To facilitate lightweight construction and enhanced illumination of a fastener in need of opening to release a vertical blind slat, as well as other advantages that will later be revealed herein, the removal device has a tubular construction. Also, although not strictly limited thereto, preferred length and diameter dimensions of the present invention main body for its convenient use are respectively four inches and two inches. Two clip-releasing strips or projections are connected across one end of the cylindrical and/or tubular main body, in positions closely spaced apart from one another, but not in contact with one another. Clip-releasing strips or projections (hereinafter "projections" without any intent of limitation) in the most preferred embodiment of the present invention are generally rectangular and approximately two inches in width dimension so that they completely span across one end of the tubular main body. When one lateral edge of each of the clip-releasing projections is positioned adjacent to a vertical blind clip on a different side of the vertical blind slat, and a constant and steady upwardly-directed force is applied via the lateral edges to the tightly-biased ends of a vertical blind clip, sufficient force can be applied to almost immediately open the clip and allow the vertical blind slat to drop from its suspended position, without any damage to the clip, the projections, walls and/or other surroundings, the person attempting such removal, or the vertical blind slat. In the alternative, using a screwdriver or other tool to release the slat from the C-shaped clip can easily lead to damage and/or operator injury since slat release is accomplished with outstretched and elevated arms. A light source can be optionally attached to the removal device in several configurations, to provide illumination of the fastener holding the vertical blind in place and thereby facilitate alignment of the operative end of the removal device with the fastener before the needed upwardly-directed dislodging force is applied. One means of attaching a light source to a tubular main body of the removal device can include a threaded connection, wherein the light travels through the tubular main body to illuminate the clip prior to and during its removal. Other light source attachment may involve lateral attachment of the light source to the outside surface of the main body. Applications include, but are not limited to, release of one or more broken vertical blind slats for subsequent replacement by a new slat, install better quality slats, or exchange of discolored and/or obsolete vertical blind slats to achieve decorative update. Advantages of the present invention are that it is quick to use, user friendly, inexpensive to manufacture, convenient and comfortable to hold in one's hand, provides reduced operator time on an elevated surface such as a ladder or chair, and substantially reduces the likelihood of breaking a vertical blind slat or clip.

The description herein provides preferred embodiments of the present invention but should not be construed as limiting its scope. For example, variation in the diameter dimension of the tubular or cylindrical main body as long as it remains easy and convenient to hold in an adult human hand; the length, width and height dimensions of the projections, as well as the distance they are spaced apart from one another as long as the distance is greater than the thickness dimension of a vertical blind slat but smaller that the width dimension of the fastener's tightly-biased ends; the means of attaching a light source to the main body; and whether the main body has any internal threads, other than those shown and described herein, may be incorporated into the present invention. Thus the scope of the present invention should be determined by the appended claims and their legal equivalents, rather than being limited to the examples given.

BRIEF DESCRIPTION OF THE SEVERAL VIEWS OF THE DRAWINGS

FIG. 1 is a front view of a prior art vertical blind, with an attachment hole near one of its ends.

FIG. 2 is a front view of a prior art C-shaped fastener commonly used to suspend a vertical blind slat in its usable position from the attachment hole shown in FIG. 1.

FIG. 3 is a side view of the most preferred embodiment of the present invention having two rigid projections mounted at a spaced-apart distance from one another on one end of a tubular main body, with the two projections oriented to extend outwardly beyond the end of the main body and in a substantially parallel configuration to one another.

DETAILED DESCRIPTION OF THE INVENTION

Figure 4:
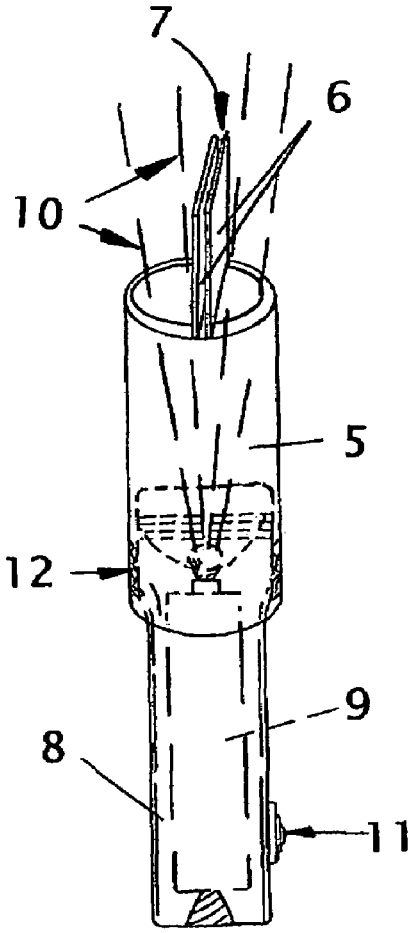
FIG. 4 is a side view of the most preferred embodiment of the present invention having a light source connected to it via threaded connection and the light source positioned to provide light through the end of the main body to which the two projections are mounted.
Figure 5:
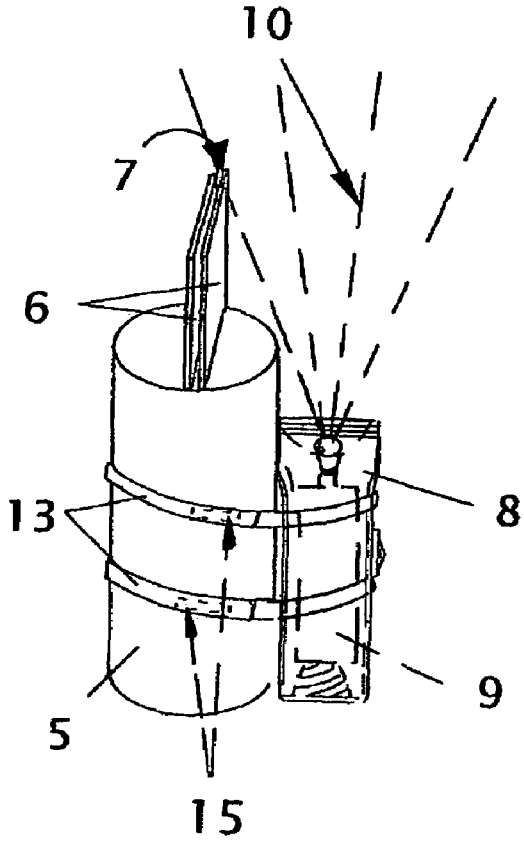
FIG. 5 is a side view of the most preferred embodiment of the present invention having a light source connected laterally to its main body using two easily-releasable straps and the light source oriented to provide released light around and beyond the end of the main body to which the two projections are mounted.
Figure 6:
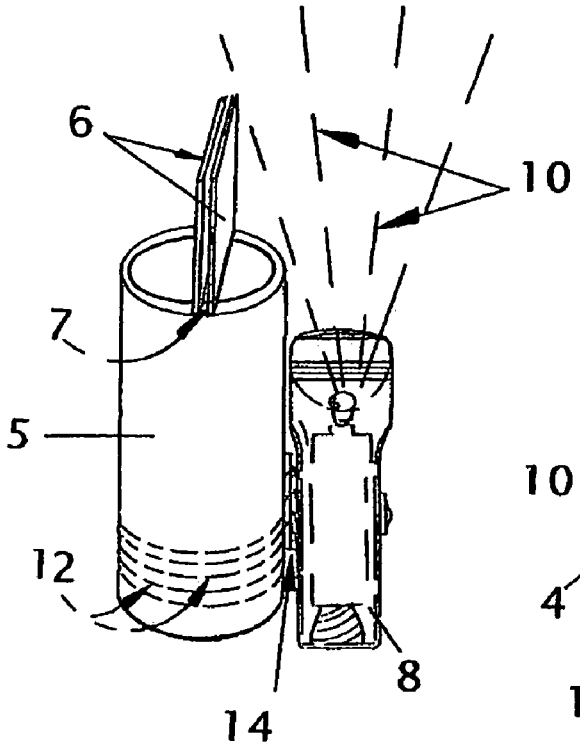
FIG. 6 is a side view of the most preferred embodiment of the present invention having a light source connected laterally to its main body using a hook-and-loop fastener and the light source oriented to provide released light around and beyond the end of the main body to which the two projections are mounted.
Figure 7:
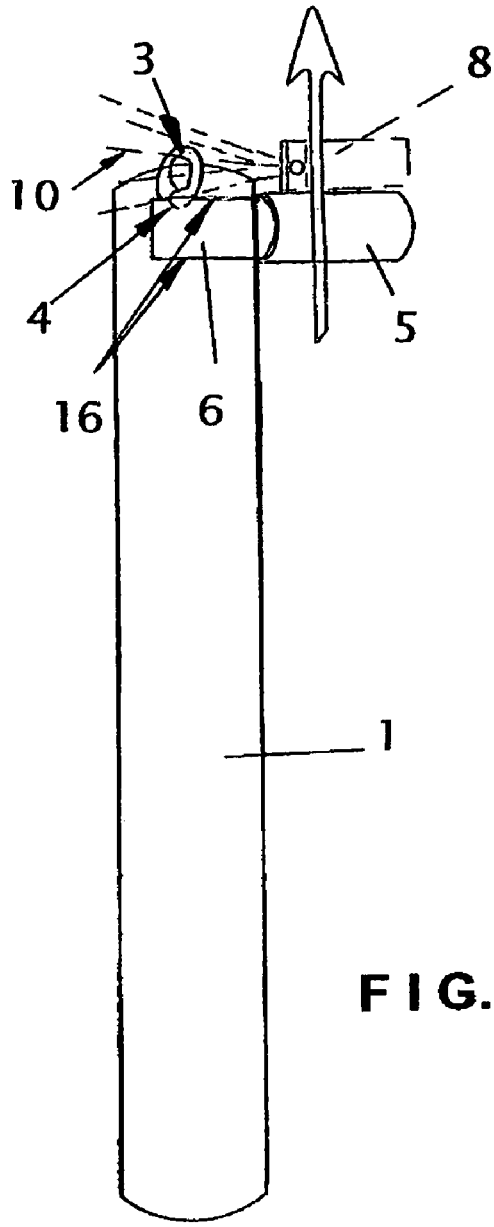
FIG. 7 is a view of the most preferred embodiment of the present invention being used to open a C-shaped fastener so that the vertical blind can drop from its suspended position for inspection, cleaning, repair, decoration and later replacement, and/or exchange.

FIGS. 1 and 2 respectively show examples of a typical vertical blind slat 1 with a connection hole 2 near its top end, and a C-shaped fastener 3 commonly used with hole 2 to connect vertical blind slat 1 in a suspended position of use wherein it can be pulled along an overhead track to adjust the amount of outside light reaching the interior space collectively behind multiple slats 1 suspended from the same overhead track. FIG. 2 shows the tightly-biased ends 4 of C-shaped fastener 3 that must be forced open by one of the lateral edges 16 of each projection 6 of the present invention to allow a slat 1 to drop away from its suspended position of use. FIGS. 3-6 show four alternative embodiments of the present invention. First, FIG. 3 shows a main body 5 and two projections 6 secured across one end of main body 5 in a closely spaced-apart configuration that creates an open-sided and open-ended slot 7, since neither projection 6 is attached to the other. Then, in contrast, FIGS. 4-6 show a light source 6 attached to main body 5 in various configurations so that released light (shown by the broken lines marked by the number 10) either travels centrally though main body 5 or laterally to it for illumination of a C-shaped clip 3, as shown in FIG. 7. It should be noted that all of the accompanying illustrations are not-to-scale drawings, and therefore should not be relied upon for relative size or measurement determinations. It should also be noted that although FIGS. 3-7 show the main body 5 of the present invention having a generally circular cross-section, any cross-sectional configuration is possible as long as it would fit conveniently and comfortably within an adult human hand during use.

FIG. 3 is a side view of the most preferred embodiment of the present invention having two rigid plate-like projections 6 each mounted at a spaced-apart distance (gap 7) from one another to one end of a short cylindrically-shaped tube, referred to herein as main body 5. As can be see in FIG. 3, one end (connected edge 17) of each plate-like projection 6 is connected to main body 5 to create an end-to-end relation therebetween. The two mounted projections 6 span across the entire width of main body 5 and are not connected to one another. Thus, an open-sided and open-ended gap 7 is formed that permits light to travel through it for enhanced illumination of a targeted vertical blind clip 3 in need of opening to release an attached slat 1. The two mounted projections 6 shown in FIG. 3 extend outwardly beyond the end of main body 5 and must have a minimum length dimension sufficient to reach the positioning of a vertical blind clip 3 when approached from one of the edges of the attached vertical blind slat 1, while slat 1 is in its suspended position of use. To pry apart the tightly-biased ends 4 of clip 3, one projection 6 is positioned against each of the opposing sides of slat 1. Since most vertical blind slats 1 used in residential and commercial applications have a width dimension of approximately four inches, the preferred configuration and minimum length and width dimensions for each projection 6 is that of a two-inch square, when used with a main body 5 also having a diameter dimension of approximately two inches. However, a length dimension for projections 6 of slightly longer than two inches is most preferred to ensure solid engagement of one of the lateral edges 16 of each projection 6 with the tightly-biased ends 4 of C-shaped clip 3 to spread them apart sufficiently to release slat 1. This is done with a constant and steady upwardly-directed force applied by the lateral edge 16 of each projection 6 against a different one of the openable ends 4 of clip 3 from positions on opposing sides of the vertical blind slat 1. Although FIG. 3 shows projections 6 extending only as far as the sides of tubular main body 5, it is considered within the scope of the present invention for the lateral edges 16 of projections 6 to extend beyond the sides of tubular main body 5 as long as doing so does not interfere with a comfortable fit in a user's hand (not shown). No threads 12 are shown in FIG. 3 for connection of a light source 8, and no light source 8 is connected to the inside or outside surfaces of main body 5. Three of the four opposed lateral edges 16 that are collectively a part of the two projections 6 shown in FIG. 3 are identified with arrows, with the fourth lateral edge 16 remaining largely hidden from view and unmarked. FIG. 3 further shows the connected edge 17 on present invention projections 6 to extend between, and depend from, the ends of each opposing lateral edge 16 that are situated closest to main body 5. In addition, although FIG. 3 shows main body 5 having a generally circular cross-sectional configuration, other configurations may also be used as long as user comfort, convenience, and low cost manufacture are also taken into consideration.

In contrast, FIGS. 4-7 show an optional connection of a light source 8 to main body 5 in varying configurations. FIG. 4 is a side view of the most preferred embodiment of the present invention having a light source 8 connected to it via threads 12 and the light source 8 positioned to provide released light 10 through the tubular end of main body 5 to which the two projections 6 are mounted. As shown in FIG. 4, released light 10 is able to travel around projections 6, as well as through gap 7. The light source 8 illustrated in FIG. 4 is in the form of a small flashlight having an internally positioned battery 9 and an externally reachable on-off switch 11. In addition, FIG. 4 shows mated threads 12 connecting the exterior surface of light source 8 with the interior surface of tubular main body 5. It is contemplated for light source 8 to project a broad beam of released light 10 toward a clip 3 (as in FIG. 7), rather than a narrow focused light beam (not shown). The relative sizes of main body 5, projections 6, and light source 8 may vary from that shown, as long as each still fulfills its intended function. Furthermore, although not shown, light source 8 can also be adapted and configured for LED use. FIG. 5 is a side view of a preferred embodiment of the present invention having a light source 8 connected laterally to main body 5 using two straps 13 each with a quick-release fastener 15, such as but not limited to hook-and-loop fasteners, hooks, or snaps. Light source 8 is in a set-back position relative to projections 6, so that at least a portion of the broad beam of released light 10 can reach clip 3 to illuminate it while an operator of the present invention aligns the lateral edges 16 of the projections 6 with the tightly-biased ends 4 of a clip 3 to force them open and release slat 1. The relative sizes of main body 5, projections 6, straps 13, fasteners 15, and light source 8 may vary from that shown, as long as each still fulfills its intended function. In addition, the number and general configuration of straps 13 and fasteners 15 can vary from that shown. One further distinction from the other embodiments of the present invention in the accompanying illustrations is that the main body 5 is shown in FIG. 5 to be cylindrical (not tubular). However, since reduced light conditions typically occur behind a valence where C-shaped clips 3 are located, it is usually better when main body 5 has a tubular construction, even though it is also possible for a cylindrical main body 5 to be effective in holding projections 6 in the closely spaced-apart position needed to release a slat 1 from it connection to a clip 3 while both slat 1 and clip 3 remain in their usable positions. FIG. 6 is a side view of the most preferred embodiment of the present invention having a light source 8 connected laterally to tubular main body 5 using at least one hook-and-loop fastener 14. In the alternative, although not shown, the area designated by the number 14 could also represent double-sided adhesive strips or a quantity of bonding agent that permanently affixes light source 8 to main body 5. Light source 8 is in a set-back position relative to projections 6, so that at least a portion of the broad beam of released light 10 can reach clip 3 to illuminate it while an operator of the present invention aligns the lateral edges 16 of the projections 6 with the tightly-biased ends 4 of a clip 3 to force them open and release slat 1. The relative sizes of main body 5, projections 6, hook-and-loop fastener 14, and light source 8 may vary from that shown, as long as each remains able to fulfill its intended function. FIG. 7 is a view of the most preferred embodiment of the present invention being used to open a fastener, C-shaped clip 3, so that the vertical blind slat 1 is easily and conveniently released without damage or injury from its usable position for inspection, cleaning, repair, decoration and later replacement, and/or exchange. The attachment of light source 8 to main body 5 in FIG. 7 is not clearly represented, but would probably be similar to that shown in FIG. 6, including but not limited to one or more hook-and-loop fasteners, double-sided tape, and/or a bonding agent.

The present invention is structured for ambidextrous use, with no differences in configuration that would need to be changed for right-handed or left-handed use. Also, there is no single upright position of use, and the projections may be used with either of its opposed lateral edges adjacent to clip 3. Further, the exterior surface of each projection (that facing away from its opposing projection) must be relatively flat, so that after opening the tightly-biased ends 4 of clip 3 the projections can easily be withdrawn therefrom without getting stuck. Furthermore, main body 5 may have a non-slip texture on its exterior surface, both main body 5 and projections 6 may have color enhancement or other decorative addition, and informational markings or logos may also be applied to (or be a part of) main body 5 or projections 6. In addition, main body 5 and projections 6 must be made from durable construction, preferably using strong plastic or metal materials. Also, light source 8 is typically a small battery-powered flashlight, perhaps less than two inches in length. When light source 8 has threaded connection to main body 5 or other connection, it is contemplated for it to have an on-off switch 11 that is easily accessed and manipulated. Although not strictly limited thereto, the most preferred length dimension of main body 5 for convenient and comfortable use of the present invention in an adult human hand, is approximately four inches, with a corresponding diameter dimension of approximately two inches. When the hollow interior of main body 5 is configured to accept an appropriately-sized battery-operated light source 8 (flashlight), it must be installed in such a way that the on-off switch 11 is easily manipulated and the battery 9 and other parts of light source 8 can be easily maintained.

We claim:

1. A hand-held device in combination with a vertical blind slat and fastener, the hand-held device for use in detaching the upper end of a suspended vertical blind slat from the tightly-biased ends of a fastener holding the slat in place for movement along an overhead track, wherein when said device is moved upwardly against the fastener's tightly-biased ends with a constant and steady force, the fastener secured through an attachment hole in the slat centrally between side edges of the slat and near its upper end is forced apart to allow the slat via gravity to drop downwardly away from fastener, without injury to the fastener, the slat, said device, surrounding areas, or the operator using it, said device comprising:

a tubular and rigid main body having a width dimension, a first end surface, and an opposed second end surface; and a first rigid and relatively flat projection having one pair of opposed lateral edges, said first projection also having an edge connected to said first end surface of said main body that spans across said width dimension of said main body to create an end-to-end relation between said first projection and said main body, with said connected edge of said first projection extending between and depending from the ends of said pair of opposing lateral edges on said first projection that are situated closest to said first end surface of said main body;

a second rigid and relatively flat projection having one pair opposed lateral edges, said second projection also having an edge connected to said first end surface of said main body that spans across said width dimension of said main body to create an end-to-end relation between said first projection and said main body, with said connected edge of said second projection extending between and depending from the ends of said pair of opposing lateral edges on said second projection that are situated closest to said first end surface of said main body; and said second projection being closely spaced apart from said first projection so as to form an open-sided and open-ended gap therebetween that is only slightly larger in width dimension than a thickness dimension of the vertical blind slat targeted for detachment from its fastener, each of said projections further having a minimum length dimension beyond said first end surface of said main body to enable it to reach the slat's attachment hole when said first end surface of said main body is positioned adjacent to one of the slat's side edges and each of said projections is positioned on a different side of the slat, wherein when said two projections are positioned against different sides of a vertical blind slat and are also located immediately below the slat's attachment hole, the one of said opposed lateral edges in each said projection that is positioned closest to the upper end of the slat can be used to apply a constant and steady upwardly-directed force against the tightly-biased ends of the vertical blind fastener engaging the slat's attachment hole until the fastener's tightly-biased ends come apart and release the slat so that it can drop downwardly via gravity away from the fastener without injury to the fastener, the slat, said device, surrounding areas, or the operator using it.

2. The detachment device of claim 1 further comprising a light source in association with said main body that is configured and positioned to provide illumination for the fastener while its tightly-biased ends are being released by said lateral edges of said projections.

3. The detachment device of claim 2 wherein said light source is connected to said main body via a threaded connection that allows released light from said light source to pass through said main body.

4. The detachment device of claim 2 wherein said light source is connected to said main body via at least one hook-and-loop fastener.

5. The detachment device of claim 2 wherein said light source is connected to said main body via at least one strap extending around both said main body and said light source.

6. The detachment device of claim 1 wherein said main body has length and diameter dimensions respectively of approximately four inches and approximately two inches.

7. The detachment device of claim 1 wherein said main body and said projections are made from plastic materials.

8. A hand-held device in combination with a vertical blind slat and fastener, the hand-held device for use in detaching the upper end of a suspended vertical blind slat from the tightly-biased ends of a fastener holding the slat in place for movement along an overhead track, wherein when said device is moved upwardly against the fastener's tightly-biased ends with a constant and steady force, the fastener secured through an attachment hole in the slat centrally between side edges of the slat and near its upper end is forced apart to allow the slat via gravity to drop downwardly away from fastener, without injury to the fastener, the slat, said device, surrounding areas, or the operator using it, said device comprising:

a rigid cylindrical main body having opposed end surfaces; and two rigid plates each having one pair of opposing lateral edges and an edge connected to said main body, with said connected edge of both said plates being connected to the same one of said opposed end surfaces of said main body, said plates further being closely spaced apart from one another so as to form an open-sided and open-ended gap having a width dimension only slightly larger than a thickness dimension of the vertical blind slat targeted for detachment from its fastener, each of said plates also having a minimum length dimension extending outwardly beyond one of said opposed ends of said main body to enable it to reach the slat's attachment hole when approached from one of the slat's side edges and each of said plates is positioned on a different side of the slat, wherein when said two plates are positioned against different sides of a vertical blind slat and are also located immediately below the slat's attachment hole, the ones of said opposing lateral edges in each said plate that is positioned closest to the upper end of the slat can be used to apply a constant and steady upwardly-directed force against the tightly-biased ends of the vertical blind fastener engaging the slat's attachment hole until the fastener's tightly-biased ends come apart and release the slat so that it can drop downwardly via gravity away from the fastener without injury to the fastener, the slat, said device, surrounding areas, or the operator using it.

9. The detachment device of claim 8 further comprising a light source in association with said main body that is configured and positioned to provide illumination for the fastener while its tightly-biased ends are being released by said lateral edges of said projections.

10. The detachment device of claim 9 wherein said light source is connected to said main body via at least one hook-and-loop fastener.

11. The detachment device of claim 9 wherein said light source is connected to said main body via at least one strap extending around both said main body and said light source.

12. The detachment device of claim 8 wherein said main body has length and diameter dimensions respectively of approximately four inches and approximately two inches.

13. The detachment device of claim 8 wherein said main body and said plates are made from plastic materials.

* * * * *